United States Patent [19]

Riedisser et al.

[11] Patent Number: 5,031,439

[45] Date of Patent: Jul. 16, 1991

[54] DRIVE FOR A MALE-MOLD-SIDE EJECTOR SLIDABLY DISPOSED IN A SLIDE OF A METAL-FORMING PRESS

[75] Inventors: Günter Riedisser, Eislingen; Oswald Barodte, Gammelshausen, both of Fed. Rep. of Germany

[73] Assignee: L. Schuler GmbH, Fed. Rep. of Germany

[21] Appl. No.: 507,523

[22] Filed: Apr. 11, 1990

[30] Foreign Application Priority Data

Apr. 12, 1989 [DE] Fed. Rep. of Germany ..... 3911921

[51] Int. Cl.[5] ..... B21J 13/14

[52] U.S. Cl. ..... 72/345; 72/427

[58] Field of Search ..... 72/344, 345, 427

[56] References Cited

FOREIGN PATENT DOCUMENTS 925566 3/1955 Fed. Rep. of Germany .
1063013 1/1960 Fed. Rep. of Germany .
1627977 2/1971 Fed. Rep. of Germany .
2339404 3/1974 Fed. Rep. of Germany .
2827561 1/1980 Fed. Rep. of Germany .
3429741 6/1985 Fed. Rep. of Germany .
235194 4/1986 German Democratic Rep. ... 72/427

*Primary Examiner*—Lowell A. Larson
*Attorney, Agent, or Firm*—Evenson, Wands, Edwards, Lenahan & McKeown

[57] ABSTRACT

A drive for a male-mold-site ejector slidably disposed in a slide of a mechanical metal-forming press has an angle lever pivoted in the slide. One leg of the angle lever act upon the end of the ejector facing away from the male mold and the other leg of the angle lever is in driving connection with a guide rod which is linked to a driving connecting rod for the slide. In a timed manner, the guide rod transmits driving movements to the angle lever. The driving connection is constructed as a link chain, in which the guide rod linked to the driving connecting rod is disposed approximately at a right angle to the moving direction of the slide and the arm of a two-armed lever linked to it extends approximately in parallel to the moving direction of the slide.

5 Claims, 3 Drawing Sheets

DRIVE FOR A MALE-MOLD-SIDE EJECTOR SLIDABLY DISPOSED IN A SLIDE OF A METAL-FORMING PRESS

BACKGROUND AND SUMMARY OF THE INVENTION

The present invention relates to a drive for a male-mold-slide ejector slidably disposed in a slide of a mechanical metal-forming press, the drive having an angle lever, one leg of which acts upon the end of the ejector facing away from the male mold, and the other leg of which is in driving connection with a guide rod which is linked to a driving connecting rod for the slide and, in a timed manner, transmits driving movements to the angle lever.

A male-mold-side ejector can be a pin-shaped ejector penetrating the male mold. This is shown, for example in German Unexamined Patent Application DE-OS 28 27 561 A1. An ejector could also comprise at least one pin guided in parallel to the male mold and outside this male mold. An ejector can also comprise an ejector sleeve surrounding the male mold, for approximately sleeve-shaped workpieces or workpieces provided with a central recess, as in for example, German Patent 925 566 C3.

A drive for a male-mold-side ejector is known, for example, from German Examined Patent Application DE-AS 16 27 977 B2. The driving connection from the guide rod to the other leg of the angle lever is established by means of another angle lever which is pivoted in the frame of the press and to one leg to which the guide rod is linked. The other leg of this additional angle lever carries an actuating plate, against which the other leg of the angle lever actuating the ejector is held by a roller. The possible stroke of the slide, in this case, is limited by the length of the actuating plate against which the roller must continue to rest. A slide adjustment for an adaptation to different heights of the female mold and the male mold is neither provided in this case, nor can it be provided on account of the possible length of the actuating plate.

Another known drive for a male-mold-side ejector which is slidably disposed in a slide of a mechanical metal forming press and which has a lever that is pivoted in the slide, is known from German Patent 10 63 013 C3. Here, the lever has one arm and its extreme end acts upon the end of the ejector facing away from the male mold, while, in an area which is closer to the linking, a control 27.03.90 cam is formed on which a roller for actuating of the ejector rolls along which is disposed in a guide rod. The guide rod is linked to a driving connecting rod for the slide and is supported by a rocker linked to the guide rod and the slide. In this known drive, an adaptation to different heights of the female mold and the male mold is possible only to a very limited extent by means of a transversely adjustable wedge.

These two known drives have a common disadvantage in that the actuating force for a stripper is transmitted by way of a roller and a surface on which this roller rolls along. This results in only a linear contact which is not suitable for the transmission of higher stripper forces and during continuous operation is subjected to considerable wear.

Drives for female-mold-side ejectors are already known in crank-driven presses. See for example DE 23 39 404 A1 and DE 34 29 741 A1. In these drives, continuous link chains are provided as a driving connection from control connecting rods serving as the drive of the ejectors to actuating members acting directly on the ejectors. The actuating members are either ejector bars which are arranged in the frame of the press so that they can be moved in the moving direction of the slide, or they are ejector shafts which are pivoted in the frame of the press and carry the cams actuating the ejectors. However, these are female-mold-side ejectors for the drive of which a transmission of movements to angle levers disposed in the slide is not required.

It is therefore an object of the present invention to avoid an actuating surface - roller pairing with only a linear contact in the driving connection and to provide the driving connection such that a slide adjustment for an adaptation to different heights of the male mold and the female mold may be provided. Further, the adaptation to different heights should not impair the operation of the driving connection for the ejector.

This and other objects are provided by a drive for a male-mold-side ejector that is slidably disposed in a slide of a mechanical metal-forming press. This drive has a slide coupled to the ejector, a driving connecting rod coupled to the slide and driving the slide, and a guide rod having first and second ends and arranged at approximately a right angle to a moving direction of the slide. The drive has a two-armed lever having first and second arms and first and second ends, the first arm extending approximately parallel to the moving direction of the slide, the first end of the two-armed lever linked to the second end of the guide rod. A pin is fixed to the slide and is coupled to the two-armed lever such that the two-armed lever pivots on the pin. An angle lever is pivotably mounted in the slide, and has a first leg which acts upon an end of the ejector, and a second leg. A bracket is provided having first and second ends, with the first end of the bracket being coupled to the second end of the two-armed lever and the second end of the bracket being coupled to the second leg of the angle lever.

In the embodiments of the present invention, the driving connection between the connecting rod used for driving the slide and the angle lever used for driving the ejector, in each case, comprises a continuous link chain in which all connections may be constructed as closed joints. The two-armed lever which, at least with its arm facing away from the angle lever, is situated approximately in parallel to the moving direction of the slide, in the driving connection, bridges the area of the slide to which the driving connecting rod is linked and permits an adjustment of this linking in the slide. These types of adjustments do not impair the operation of the drive for the ejector because of the position of the guide rod approximately at a right angle with respect to the moving direction of the slide.

By adding another bracket in an embodiment of the invention, the link chain is advantageously lengthened to the connection with the ejector or a control pin acting upon this ejector.

By providing adjustability of the sliding pad carrying the pin in a circular-arc-shaped guide in the two-armed lever according to an embodiment of the invention, a changing of the transmission ratio is achieved between the excursion of the guide rod caused by the excursion of the driving connecting rod and the excursion of the angle lever, and thus the stroke of the ejector is changed.

In any case, the maximum of the stroke of the ejector during the return stroke of the slide occurs approximately at the position of the driving connecting rod which is achieved at 90 degrees crank angle after the lower/front dead center.

The present invention can be used in metal-forming presses with a vertical moving direction of the slide as well as in those with a horizontal moving direction of the slide, specifically in single-stage as well as in multi-stage metal-forming presses.

Other objects, advantages and novel features of the present invention will become apparent from the following detailed description of the invention when considered in conjunction with the accompanying drawings.

DETAILED DESCRIPTION OF THE DRAWINGS

Figure 1:
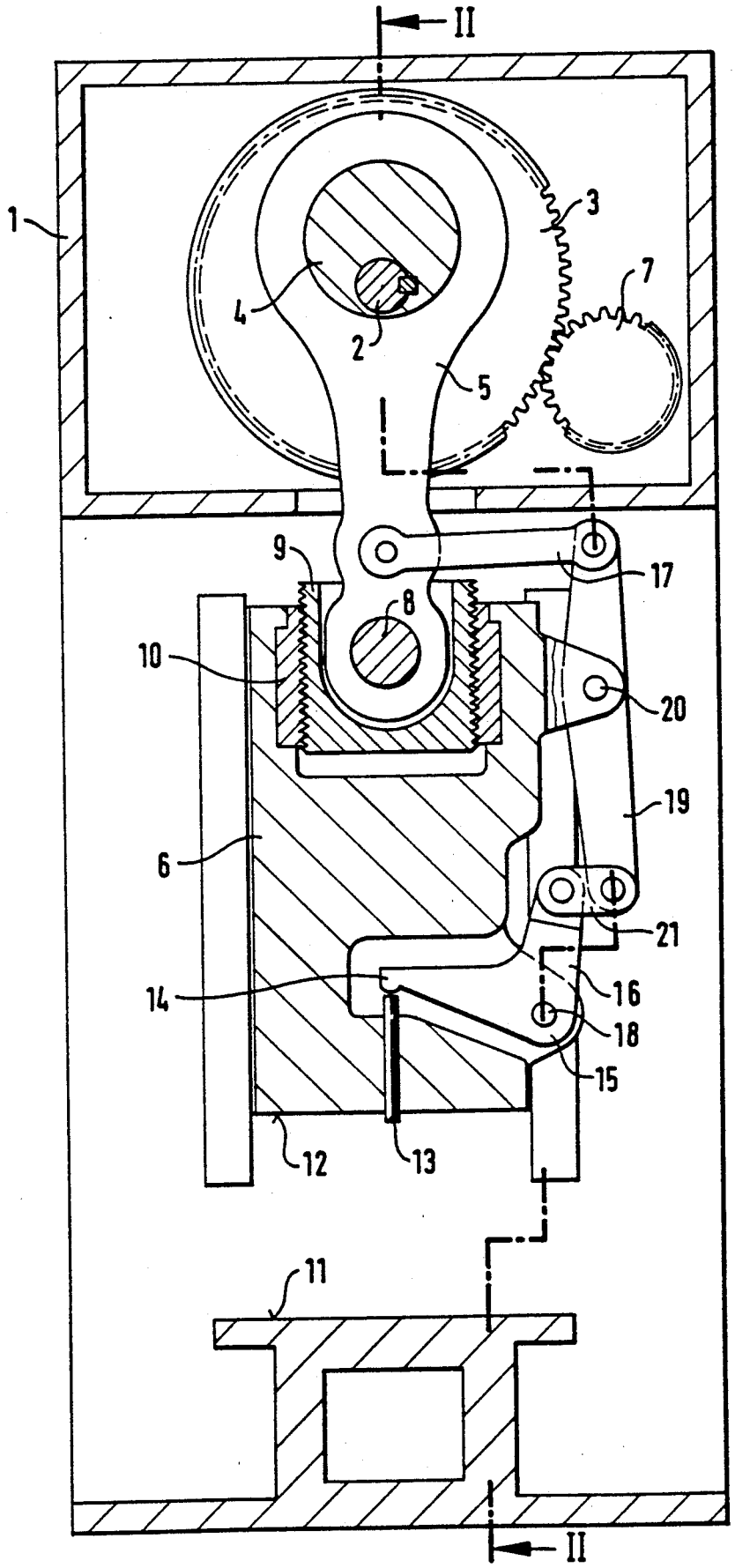
FIG. 1 is a vertical sectional view in a plane which is penetrated vertically by its main drive shaft of a metal-forming press constructed in accordance with an embodiment of the present invention.

In FIG. 1, a main drive shaft 2 is provided in a frame 1 of a metal-forming press. This main drive shaft 2 can be driven by a motor (not shown) by way of a toothed wheel 3 and a pinion 7 connected in front of it. The main drive shaft 2 carries an eccentricity 4 on which one end of a driving connecting rod 5 is arranged. The other end of the driving connecting rod 5 is linked to a slide 6 which is vertically movably guided in the frame 1. The linking of the slide 6 to the driving connecting rod 5 is established by means of a bearing bolt 8 which is arranged in an external-thread adjusting part 9. An internal-thread adjusting sleeve 10 is provided which surrounds the external-thread adjusting part 9 and interacts with it and is disposed in the slide 6 in an axially non-slidable, but rotatable and lockable manner. The external-thread/internal-thread pairing serves to adjust the linking in the slide 6 for adaptation of the metal-forming press to different heights of the female mold and of the male mold.

At the frame 1, a table-type holding surface 11 is provided in its lower part for a female mold (not shown) that is to be held on it. A male mold (also not shown), which is fastened to a slide bottom 12 of the slide 6, interacts with the female mold. A pin-shaped ejector (not shown) may be provided in the female mold which penetrates this female mold and which can be acted upon by a drive for this ejector which is not shown. A pin-shaped ejector which penetrates the male mold is movably guided in this male mold.

A control pin 13, which is displaceably guided in the slide 6, is disposed on the end of the ejector facing away from the impression of the male mold. The end of this control pin 13 facing away from the ejector is acted upon by a leg 14 of an angle lever 15. The angle lever 15 is pivotally disposed on a shaft 18 in the slide 6. The other leg 16 of the angle lever 15 is in driving connection with a guide rod 17 that is arranged approximately at a right angle with respect to the moving direction of the slide 6 and, is linked at one end to the driving connecting rod 5.

Figure 2:
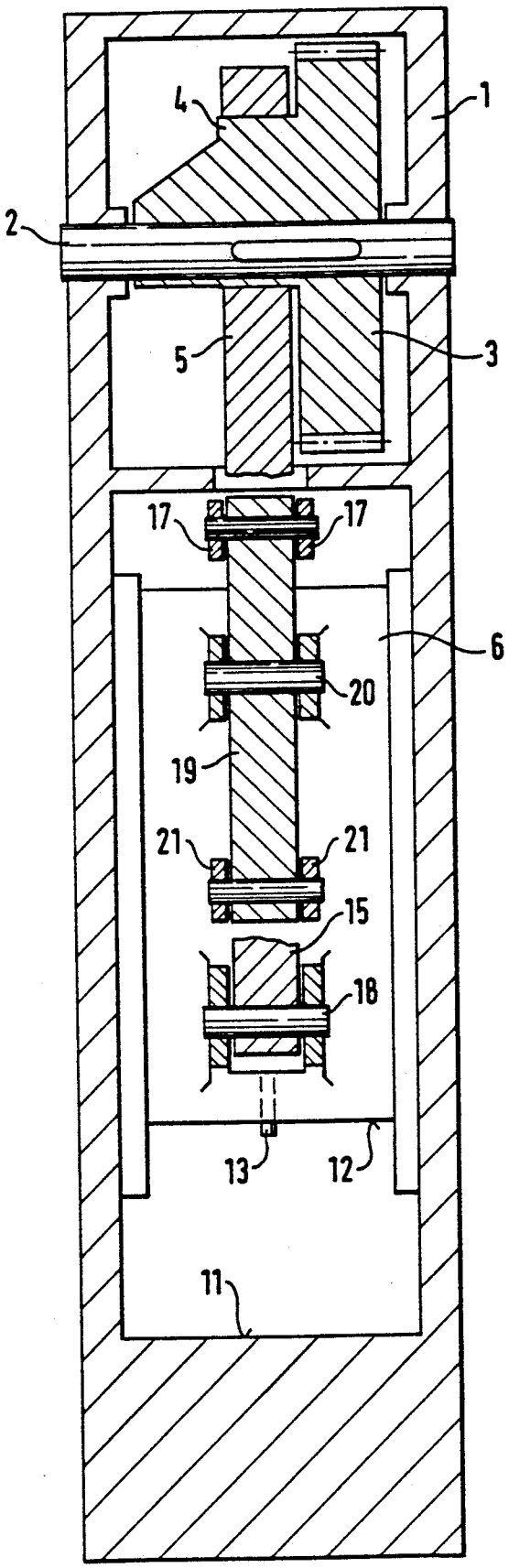
FIG. 2 is a sectional view along Line II—II of FIG. 1.

In the embodiment of FIGS. 1 and 2, one end of a two-armed lever 19 is linked to the end of the guide rod 17 which faces away from the driving connecting rod 5. The two-armed lever 19, in its center area, is arranged on a pin 20 which is fastened to the slide 6. A bracket 21 is linked to the end of the lever 19 which faces away from the linking of the guide rod 17. The bracket 21, at its other end, is linked to the leg 16 of the angle lever 15 that faces away from the control pin 13. The leg 14 of the angle lever 15 which faces the control pin 13, has its end held in contact against the end of the control pin 13 facing away from the male mold.

Figure 3:
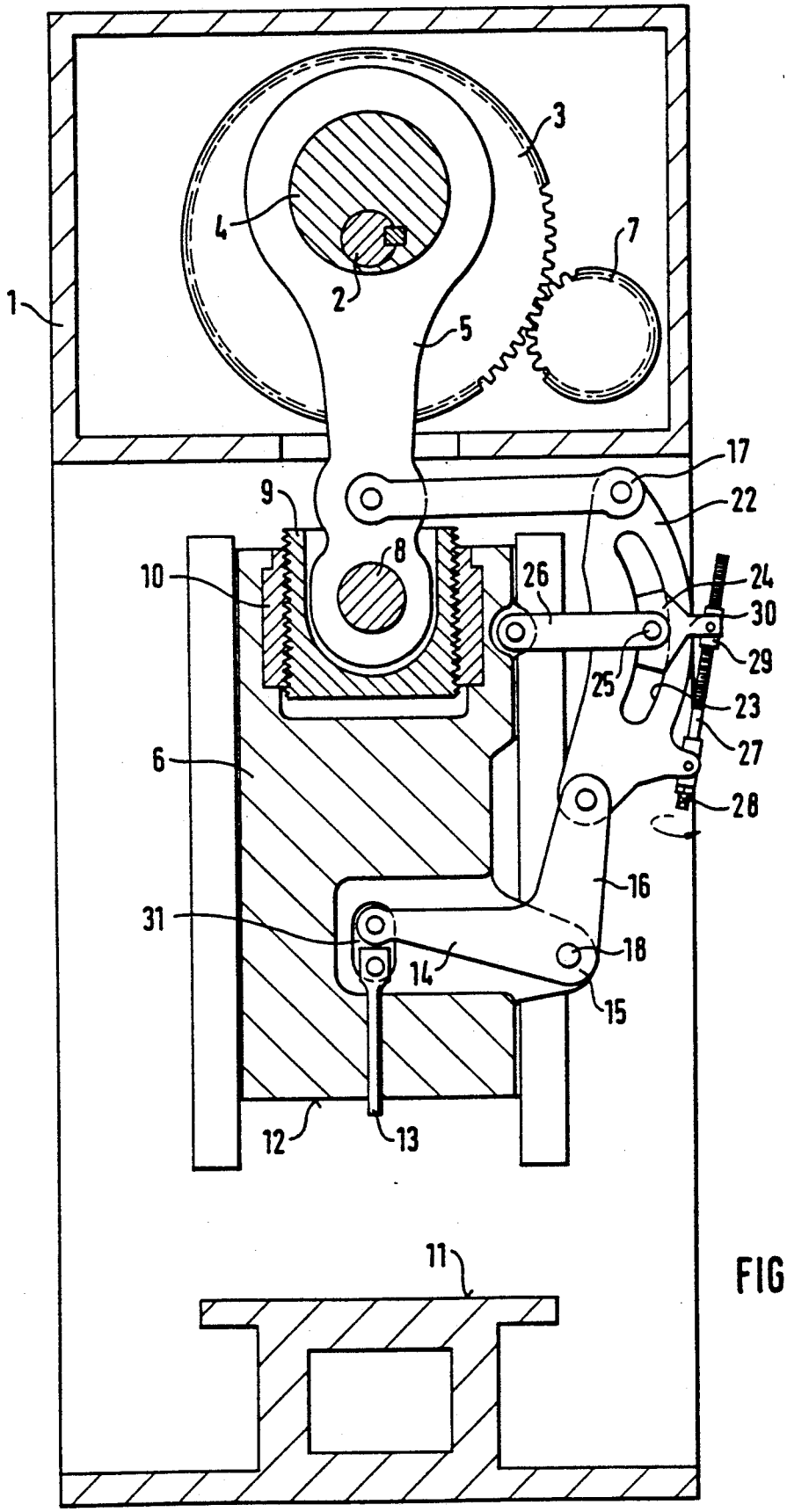
FIG. 3 is a vertical sectional view in a plane which is penetrated vertically by its main drive shaft of a metal-forming press constructed in accordance with another embodiment of the present invention.

In the embodiment of FIG. 3, one end of a two-armed lever 22 is linked to the end of the guide rod 17 which faces away from the driving connecting rod 5. This two-armed lever 22, in its center area, has a circular-arc-shaped guide 23 in which a sliding pad 24 is adjustably and lockably disposed. The sliding pad 24 has a pin 25 which is used as the linking for one end of a bracket 26, the other end of which is linked to the slide 6. The radius of the guide 23 is equal to the effective length of the bracket 26. A screw spindle 27 which is pivotally disposed at the lever 22 is used for the adjusting and locking of the sliding pad 24 in the guide 23. This screw spindle 27, in axial direction, is fixed in the bearing at the lever 22, but is rotatable by means of a square key. A threaded nut 29 is disposed on the screw spindle 27 and is pivotally disposed in a lug 30 at the sliding pad 24. The end of the lever 22 which faces away from the linking with the guide rod 17 is linked to the leg 16 of the angle lever 15 facing away from the control pin 13. The leg 14 of the angle lever 15 facing the control pin 13 is pivotally connected with the control pin, by another bracket 31.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by terms of the appending claims.

What is claimed:

1. A drive mechanism for a slide of a mechanical metal-forming press and for a male-mold-side ejector which is slidable between a retracted position and an extended position, the mechanism comprising:

a driving connecting rod coupled to the slide for driving the slide;

a guide rod having first and second ends, the first end being coupled to the driving connecting rod, the guide rod being disposed at approximately right angle to a moving direction of the slide;

a two-armed lever having a fulcrum, a first arm including a first end, and a second arm including a second end, the first arm extending approximately parallel to the moving direction of the slide, the first end being coupled to the second end of the guide rod;

a first bracket having a first end coupled to the slide and a second end;

a first pin fixed to the second end of the first bracket and coupled to the fulcrum of the two-armed lever such that the two-armed lever pivots about the first pin; and an angle lever having a fulcrum pivotably mounted to the slide, a first leg coupled to the ejector for urging the ejector toward the extended position responsive to motion of the driving connecting rod, and a second leg coupled to the second end of the two-armed lever.

2. A drive according to claim 1, further comprising a control pin that acts upon the ejector, and a second bracket coupled to the control pin and pivotally coupled to the first leg of the angle lever.

3. A drive according to claim 2, further comprising a sliding pad coupled to said first pin, said two-armed lever having a circular-arc-shaped guide, the radius of this guide being equal to the effective length of the first bracket, wherein the sliding pad is adjustably mounted in the circular-arc-shaped guide.

4. A drive mechanism for a slide of a mechanical metal-forming press and for a male-mold-side ejector that is slidably disposed in the slide, the ejector being slidable between a retracted position and an extended position, the mechanism compromising:

a driving connecting rod coupled to the slide for driving the slide;

a guide rod having first and second ends, the first end being coupled to the driving connecting rod, the guide rod being disposed at approximately a right angle to a moving direction of the slide;

a two-armed lever having a fulcrum, a first arm including a first end, and a second arm including a second end, the first arm extending approximately parallel to the moving direction of the slide, the first end being coupled to the second end of the guide rod;

a pin fixed to the slide at an intermediate position between the driving connecting rod and the ejector and coupled to the fulcrum of the two-armed lever such that the two-armed lever pivots about the pin;

an angle lever having a fulcrum pivotably mounted to the slide at a position near the ejector and spaced away from the fulcrum of the two-armed lever, a first leg coupled to the ejector for urging the ejector toward the extended position responsive to motion of the driving connecting rod, and a second leg;

a bracket having first and second ends, the first end of the bracket being coupled to the second end of the two-armed lever and the second end of the bracket being coupled to the second leg of the angle lever.

5. An ejector drive mechanism for a press including a driving connecting rod and an ejector, the mechanism comprising:

a first lever having a fulcrum disposed intermediately between the driving connecting rod and the ejector, a first arm extending from the fulcrum toward the driving connecting rod, and a second arm having a second end extending from the fulcrum toward the ejector, the firs arm being coupled to the driving connecting rod to move responsive to motion of the driving connecting rod, wherein the first lever bridges an area between the driving connecting rod and a stroke of the second end is proportional to a length of the second arm from the fulcrum to the second end; and a second lever having a fulcrum disposed near the ejector and spaced away from the fulcrum of the first lever, a first arm coupled to the ejector, and a second arm coupled to the second end of the second arm of the first lever, wherein the first arm moves the ejector responsive to movement of the second arm of the first lever.

* * * * *

US005031439A

REEXAMINATION CERTIFICATE (2050th)

United States Patent [19]

[11] B1 5,031,439

Riedisser et al.

[45] Certificate Issued Jun. 29, 1993

[54] DRIVE FOR A MALE-MOLD-SIDE EJECTOR SLIDABLY DISPOSED IN A SLIDE OF A METAL-FORMING PRESS

[75] Inventors: Günter Riedisser, Eislingen; Oswald Barodte, Gammelshausen, both of Fed. Rep. of Germany

[73] Assignee: L. Schuler GmbH, Fed. Rep. of Germany

Reexamination Request:
No. 90/002,746, Jun. 8, 1992

Reexamination Certificate for:

| | |
|---|---|
| Patent No.: | **5,031,439** |
| Issued: | **Jul. 16, 1991** |
| Appl. No.: | **507,523** |
| Filed: | **Apr. 11, 1990** |

[30] Foreign Application Priority Data

Apr. 12, 1989 [DE] Fed. Rep. of Germany ..... 3911921

[51] Int. Cl.[5] ..... B21J 13/14

[52] U.S. Cl. ..... 72/345; 72/427

[58] Field of Search ..... 72/345, 427

[56] References Cited

FOREIGN PATENT DOCUMENTS 137928 8/1970 Czechoslovakia .

*Primary Examiner*—Lowell A. Larson

[57] ABSTRACT

A drive for a male-mold-site ejector slidably disposed in a slide of a mechanical metal-forming press has an angle lever pivoted in the slide. One leg of the angle lever act upon the end of the ejector facing away from the male mold and the other leg of the angle lever is in driving connection with a guide rod which is linked to a driving connecting rod for the slide. In a timed manner, the guide rod transmits driving movements to the angle lever. The driving connection is constructed as a link chain, in which the guide rod linked to the driving connecting rod is disposed approximately at a right angle to the moving direction of the slide and the arm of a two-armed lever linked to it extends approximately in parallel to the moving direction of the slide.

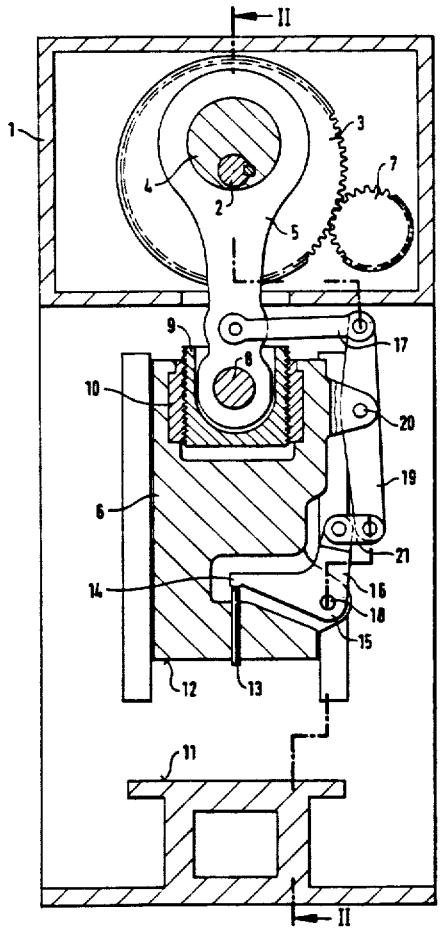

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4 and 5 are determined to be patentable as amended.

Claim 3, dependent on an amended claim, is determined to be patentable.

1. A drive mechanism for a slide of a mechanical metal-forming press and for a male-mold-side ejector which is slidable between a retracted position and an extended position, the mechanism comprising:

a driving connecting rod coupled to the slide for driving the slide;

a guide rod having first and second ends, the first end being coupled to the driving connecting rod, the guide rod being disposed at approximately right angle to a moving direction of the slide;

a two-armed lever having a fulcrum, a first arm including a first end, and a second arm including a second end, the first arm extending approximately parallel to the moving direction of the slide, the first end being coupled to the second end of the guide rod;

a first bracket having a first end coupled to the slide and a second end;

a first pin fixed to the second end of the first bracket and coupled to the fulcrum of the two-armed lever such that the two-armed lever pivots about the first pin; and an angle lever having a fulcrum pivotably mounted to the slide, a first leg [coupled] *having a free end at a distance from the fulcrum, the free end being one of in direct contact and in contact via only a single bracket* to *a control pin of* the ejector for urging the ejector toward the extended position responsive to motion of the driving connecting rod, and a second leg [coupled] *being one of in direct contact and in contact via only a single bracket* to the second end of the two-armed lever.

2. A drive according to claim 1, further comprising a control pin that acts upon the ejector, and a [second] *third* bracket coupled to the control pin and pivotally coupled to the first leg of the angle lever.

4. A drive mechanism for a slide of a mechanical metal-forming press and for a male-mold-side ejector that is slidably disposed in the slide, the ejector being slidable between a retracted position and an extended position, the mechanism compromising:

a driving connecting rod coupled to the slide for driving the slide;

a guide rod having first and second ends, the first end being coupled to the driving connecting rod, the guide rod being disposed at approximately a right angle to a moving direction of the slide;

a two-armed lever having a fulcrum, a first arm including a first end, and a second arm including a second end, the first arm extending approximately parallel to the moving direction of the slide, the first end being coupled to the second end of the guide rod;

a pin fixed to the slide at an intermediate position between the driving connecting rod and the ejector and coupled to the fulcrum of the two-armed lever such that the two-armed lever pivots about the pin;

an angle lever having a fulcrum pivotably mounted to the slide at a position near the ejector and spaced away from the fulcrum of the two-armed lever, a first leg [coupled to] *being one of in direct contact with and in contact with via only a single bracket to a control pin of* the ejector for urging the ejector toward the extended position responsive to motion of the driving connecting rod, and a second leg;

a bracket having first and second ends, the first end of the bracket being [coupled to] *in direct contact with* the second end of the two-armed lever and the second end of the bracket being [coupled to] *in direct contact with* the second leg of the angle lever.

5. An ejector drive mechanism for a press including a driving connecting rod and an ejector, the mechanism comprising:

a first lever having a fulcrum disposed intermediately between the driving connecting rod and the ejector, a first arm extending from the fulcrum toward the driving connecting rod, and a second arm having a second end extending from the fulcrum toward the ejector, the first arm being coupled to the driving connecting rod to move responsive to motion of the driving connecting rod, wherein the first lever bridges an area between the driving connecting rod and a stroke of the second end is proportional to a length of the second arm from the fulcrum to the second end; and a second lever having a fulcrum disposed near the ejector and spaced away from the fulcrum of the first lever, a first arm [coupled to] *being one of in direct contact with or in contact with via only a single bracket to a control pin of* the ejector, and a second arm [coupled] *being one of in direct contact with or in contact with via only a single bracket* to the second end of the second arm of the first lever, wherein the first arm moves the ejector responsive to movement of the second arm of the first lever.

* * * * *